US008938832B2

(12) United States Patent
Barnhart et al.

(10) Patent No.: US 8,938,832 B2
(45) Date of Patent: Jan. 27, 2015

(54) WHEEL WEIGHT TOOL

(71) Applicants: Russell B. Barnhart, Lexington, NC (US); Kim M. Barnhart, Lexington, NC (US)

(72) Inventors: Russell B. Barnhart, Lexington, NC (US); Kim M. Barnhart, Lexington, NC (US)

(73) Assignee: U.W.T. Inc., Lexington, NC (US)

( * ) Notice: Subject to any disclaimer, the term of this patent is extended or adjusted under 35 U.S.C. 154(b) by 220 days.

(21) Appl. No.: 13/645,920

(22) Filed: Oct. 5, 2012

(65) Prior Publication Data

US 2013/0025102 A1 Jan. 31, 2013

Related U.S. Application Data

(63) Continuation-in-part of application No. 13/110,064, filed on May 18, 2011, now Pat. No. 8,468,630.

(60) Provisional application No. 61/544,414, filed on Oct. 7, 2011.

(51) Int. Cl.

| | |
|---|---|
| ***B25F 1/00*** | (2006.01) |
| ***B25B 27/14*** | (2006.01) |
| ***B25B 27/00*** | (2006.01) |

(52) U.S. Cl.

CPC ..... *B25F 1/006* (2013.01); *B25B 27/0078* (2013.01); *B25D 2250/111* (2013.01)

USPC ..... 7/100; 254/131

(58) Field of Classification Search

USPC ..... 7/100; 254/131

See application file for complete search history.

(56) References Cited

U.S. PATENT DOCUMENTS

| | | | | |
|---|---|---|---|---|
| 834,908 | A | | 11/1906 | Hussey |
| D58,663 | S | | 8/1921 | Crampton |
| 1,689,585 | A | | 10/1928 | Haschart |
| 2,274,126 | A | | 2/1942 | Carrigan |
| 2,314,145 | A | | 3/1943 | Kalajian |
| D155,929 | S | | 11/1949 | Schildmeier |
| D160,605 | S | | 10/1950 | Iskyan |
| D161,034 | S | | 11/1950 | Marthinsen |
| D163,533 | S | | 6/1951 | Mills |
| 2,883,153 | A | | 4/1959 | Abbott |
| D192,101 | S | | 1/1962 | Brown, Jr. |
| D192,721 | S | | 5/1962 | Mills |
| 3,152,391 | A | | 10/1964 | Bjorn et al. |
| D203,296 | S | | 12/1965 | Quartararo |
| D203,297 | S | | 12/1965 | Quartararo |
| 3,688,380 | A | * | 9/1972 | Dionys Hofmann et al. ..... 29/243.56 |
| 3,721,282 | A | | 3/1973 | Hayes et al. |
| 3,793,656 | A | | 2/1974 | Songer et al. |
| 3,852,839 | A | | 12/1974 | Blessing |
| 4,268,926 | A | | 5/1981 | Roxton |

(Continued)

FOREIGN PATENT DOCUMENTS

WO WO 02/18104 A1 3/2002

OTHER PUBLICATIONS

Myers Tire Supply, catalog, 2007, p. 124.

*Primary Examiner* — David B Thomas

(74) *Attorney, Agent, or Firm* — Jeffrey C. Watson; Balser & Grell IP Law, L.L.P.

(57) ABSTRACT

A wheel weight tool includes a handle connected to a hammer head on a first end and having a first hook on a second end. The first hook may be adapted for removing a wheel weight. The hammer head has a soft end and a hard end. The hard end may include a second hook.

16 Claims, 11 Drawing Sheets

(56) References Cited

U.S. PATENT DOCUMENTS

| | | | |
|---|---|---|---|
| 4,393,908 | A | 7/1983 | Clay |
| D271,372 | S | 11/1983 | Fortune |
| D301,962 | S | 7/1989 | Huang |
| 5,044,033 | A | 9/1991 | Fosberg |
| D377,745 | S | 2/1997 | Laun |
| 5,743,285 | A | 4/1998 | Shalkevich |
| D407,289 | S | 3/1999 | Swenson, Jr. |
| D416,777 | S | 11/1999 | Swenson, Sr. |
| D429,987 | S | 8/2000 | Hung |
| 6,446,318 | B1 | 9/2002 | Foose |
| 6,536,308 | B1 | 3/2003 | Thorne et al. |
| 6,915,936 | B2 | 7/2005 | Estes |
| D519,820 | S | 5/2006 | Newman et al. |
| D586,642 | S | 2/2009 | Budacz, III |
| D620,337 | S | 7/2010 | Nuttall et al. |
| 2005/0060860 | A1 | 3/2005 | Kang |
| 2007/0017321 | A1 | 1/2007 | Doney |

* cited by examiner

WHEEL WEIGHT TOOL

CROSS-REFERENCE TO RELATED APPLICATIONS

This application claims the benefit and priority of U.S. Provisional Application No. 61/544,414 filed Oct. 7, 2011 and is a continuation-in-part of application Ser. No. 13/110,064, filed May 18, 2011, which claims the benefit of U.S. Provisional Patent Application Ser. No. 61/359,026 filed Jun. 28, 2010.

FIELD OF THE INVENTION

The instant invention is directed toward tools for use on wheels like automobile wheels, and more specifically, tools for use with wheel weights utilized on wheels like automobile wheels.

BACKGROUND OF THE INVENTION

Every year millions of small weights are attached to tires by automotive technicians balancing them. Tire balance, also referred to as tire unbalance or imbalance, describes the distribution of mass within an automobile tire and/or the wheel to which it is attached. When the tire rotates, asymmetries of mass cause the wheel to wobble. This wobbling can give rise to ride disturbances, usually vertical and lateral vibrations. It can also result in a wobbling of the steering. The ride disturbance due to unbalance usually increases with speed. Vehicle suspensions can be excited by tire unbalance forces when the speed of the wheel reaches a point that its rotating frequency equals the suspension's resonant frequency. Tires are inspected in factories and repair shops by two methods: static balancers and dynamic balancers. Tires with high unbalance forces are downgraded or rejected. When tires are fitted to wheels at the point of sale, they are measured again, and wheel weights, also known as correction weights, are applied to counteract the combined effect of the tire and wheel unbalance.

Automotive technicians reduce the wobble to an acceptable level when balancing the wheel by adding small wheel weights to the inner and outer wheel rims. A wheel weight is installed by the use of a wheel weight and/or clip that secures the wheel weight to the edge of the wheel. A common garage tool, like a hammer, is typically used to hammer the wheel weight and/or clip down onto the wheel. To remove the wheel weight and/or clip another common garage tool, similar to a pair of pliers or a screw driver, are typically used to grasp and pinch or pry the wheel weight and/or clip to remove the wheel weight.

Traditionally, wheel weights have been made of lead. However, to reduce environmental concerns, steel and zinc weights are being used more frequently. These steel and zinc weights are typically coated. The coated weights have a coating on them which have been discovered to chip or scratch during the installation or removal of the wheel weight by standard wheel weight tools. In addition to the problem with the wheel weight chipping or scratching during installation and removal, the actual wheels themselves (or coatings on the wheels) have been discovered to chip and or scratch around its edges during installation or removal of the wheel weight with standard wheel weight tools. As should be understood these chipped and/or scratched portions of the wheel and/or wheel weights are undesirable for vehicle owners.

It is thus highly desirable to create a wheel weight tool for installing and/or removing wheel weights that may be easier to use than common garage tools and may reduce or prevent chips and/or scratches on the wheel weight and/or wheel itself.

One problem with providing a wheel weight removal tool for removing wheel weights is that there are many different sizes and shapes of wheel weights. See the Wheel Weights Table at http://www.wheelweights.com/pdf/Wheel_Weights_CompleteWeightsChart.pdf [retrieved on Oct. 3, 2012]. The five major manufacturers that supply wheel weights in the US are IMI, Hennessy (BADA), JM Nault, Perfect Equipment, and Plumbco. Each manufacturer's weights may differ in where the hole is located on the "clip", as well as the style and size of said hole. See http://www.wheelweights.com/pdf/Wheel_Weights_Flange_Chart.pdf [retrieved on Oct. 3, 2012].

Consequently, it has been discovered that the tire industry currently has many problems with wheel-weight removal due to the changes in design and material of wheel weights being produced, not to mention the number of different wheel weights on today's market. The tools used to remove wheel weights over the last 50 years have been mainly plier type removers and they are no longer sufficiently able to handle the challenges of removing all of the weights being sold and applied in today's market, including tires with curb rubber which adds additional challenges. This issue will only get worse with the current "phasing out" of lead weights, which will most likely be completely implemented throughout the U.S. in the near future. Additionally, rim damage due to the current tools scratching wheels and rims and the additional high cost of workman's comp claims filed due to injuries sustained by tire changer's (employee's) fingers and hands by using pliers type wheel weight removers.

As a result, there is clearly a need for a wheel weight removal tool that can accommodate many different size and shapes of wheel weights, including many different sized and shaped holes on the clips, that is fast and easy to operate, and reduces or eliminates scratching or pinching even on tires with curb rubber.

The instant invention is designed to address the above mentioned problems.

DESCRIPTION OF DRAWINGS

For the purpose of illustrating the invention, there is shown in the drawings a form that is presently preferred; it being understood, however, that this invention is not limited to the precise arrangements and instrumentalities shown.

SUMMARY OF THE INVENTION

The instant invention is directed toward a wheel weight tool. The wheel weight tool includes a handle connected to a hammer head on a first end and having a first hook on a second end. The first hook may be adapted for removing a wheel weight. The hammer head has a soft end and a hard end. The hard end may include a second hook.

The instant invention is also directed toward a wheel weight removal hook adapted to remove a wheel weight. The wheel weight removal hook includes a tip point, a throat, and a heel. The tip point is adapted to be inserted into the hole of a wheel weight and clip. The throat is adapted to fit around the wheel weight and clip. The heel is adapted to be positioned against the weight and/or clip when the tip is inserted into the clip hole. Wherein, when the tip point is inserted into the hole of a wheel weight clip where the heel is positioned against the weight and/or clip, the hook may be rotated for removing the wheel weight and clip from a wheel.

DETAILED DESCRIPTION OF THE DRAWINGS

Figure 1:
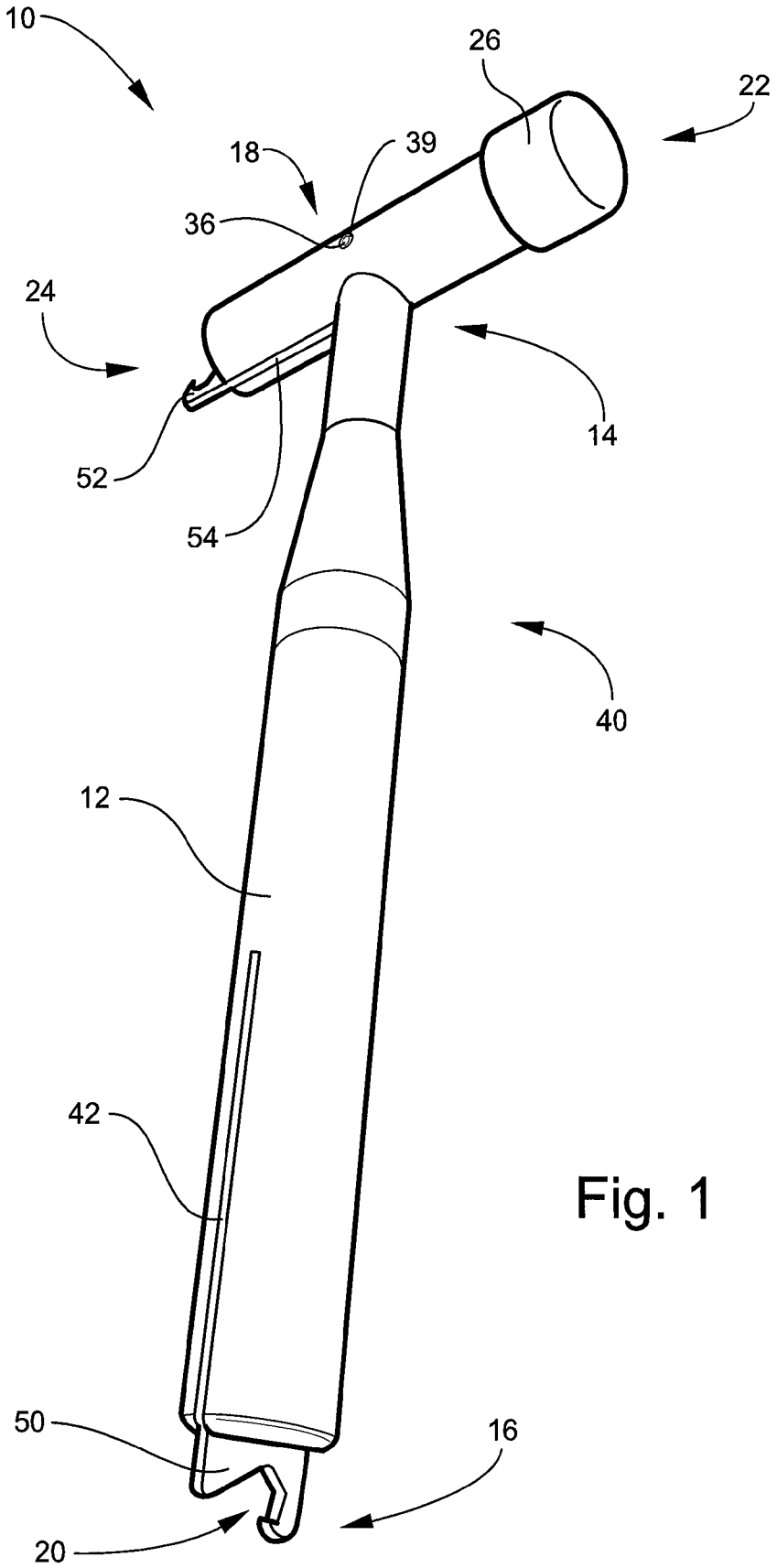
FIG. 1 shows a perspective view of one embodiment of the wheel weight tool according to the instant invention.
Figures 2, 3:
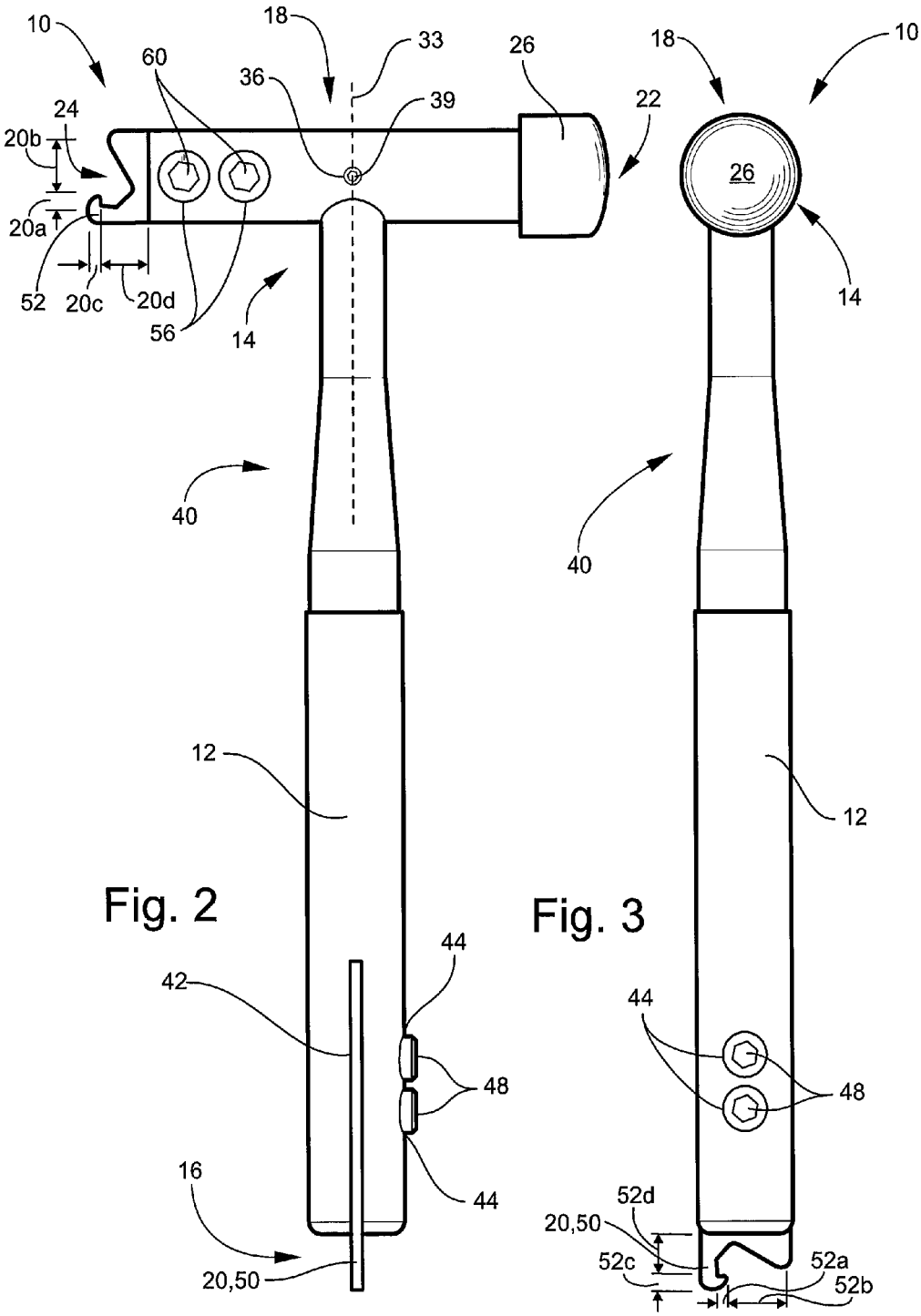
FIG. 2 shows a front view of the wheel weight tool from FIG. 1.
FIG. 3 shows a first side view of the wheel weight tool from FIG. 1 of the side with the soft end.
Figure 4:
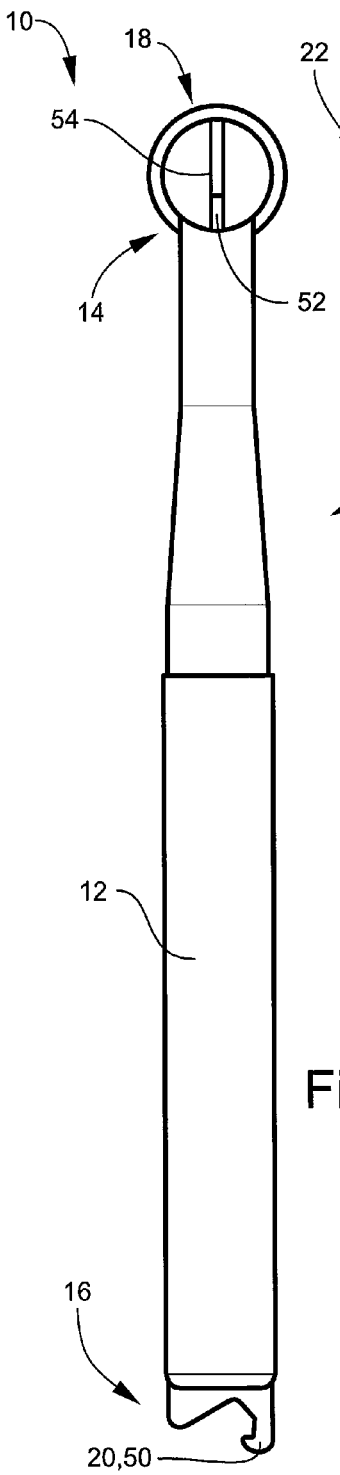
FIG. 4 shows a second side view of the wheel weight tool from FIG. 1.
Figure 5:
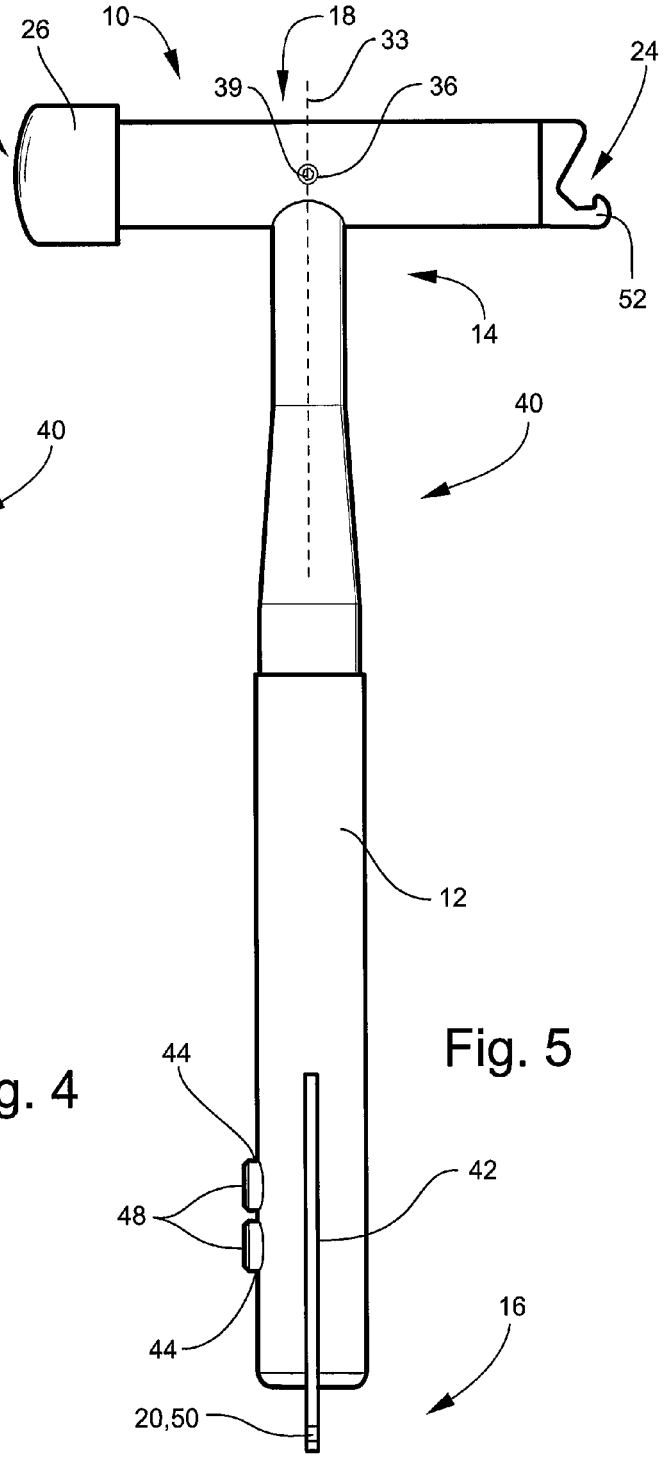
FIG. 5 shows a back view of the wheel weight tool from FIG. 1.
Figure 6:
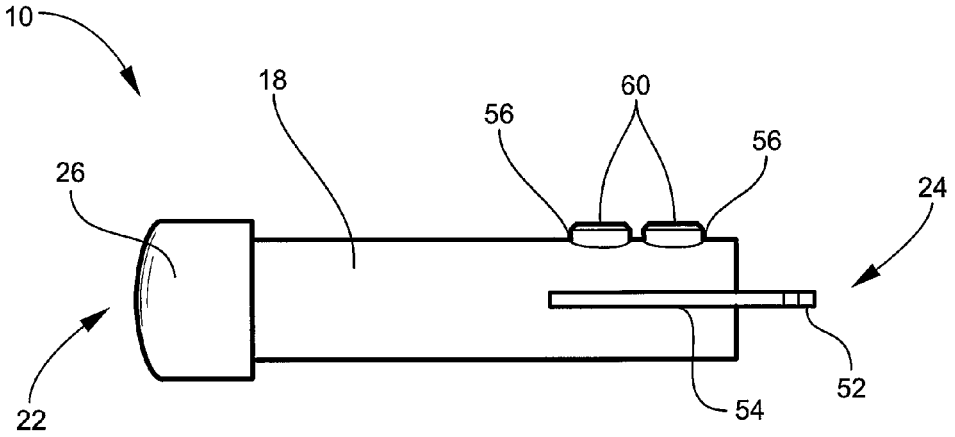
FIG. 6 shows a top view of the wheel weight tool from FIG. 1.
Figure 7:
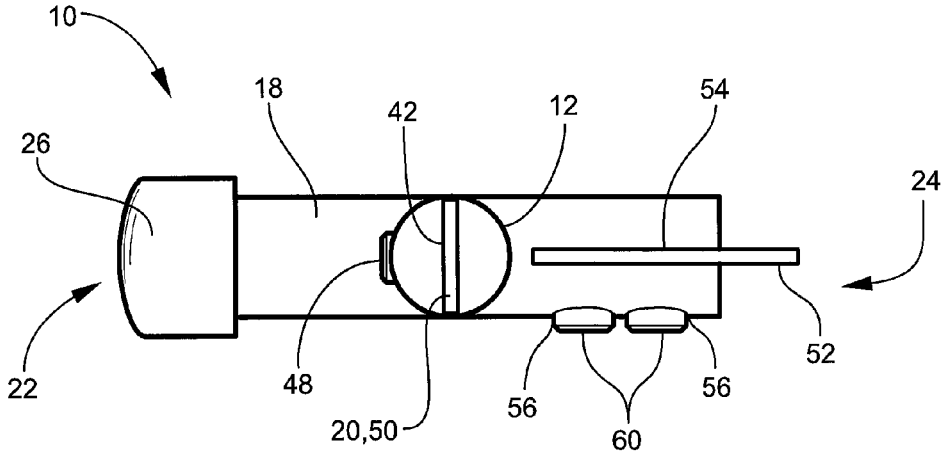
FIG. 7 shows a bottom view of the wheel weight tool from FIG. 1.

Referring to the drawings, wherein like numerals indicate like elements, there is shown in FIG. 1 an embodiment of a wheel weight tool 10. Wheel weight tool 10 may be for use by automobile technicians in installing and removing wheel weights from wheels like automobile wheels. However, the invention is not so limited, and wheel weight tool 10 may be utilized for other purposes by automobile technicians and other mechanical uses outside of the automobile field. Wheel weight tool 10 may generally include a handle 12, a hammer head 18, and a first hook 20. These parts and other optional parts will be described in greater detail below.

Handle 12 may be included in wheel weight tool 10. See FIGS. 1-10. Handle 10 may be for providing the main body and handle of tool 10. Handle 12 may have hammer head 18 connected to a first end 14 and a first hook 20 on a second end 16. Handle 10 may be any desired size and shape. Handle 12 may have any length. In one embodiment, handle 12 may have a length of between 5 and 20 inches. In another embodiment, handle 12 may have a length of approximately 10 inches. In yet another embodiment, handle 12 may have a length of 9.5 inches. In one embodiment, handle 12 may have a cylindrical shape with a circular cross-section. In this embodiment, handle 12 may have any size radius. In one embodiment, the radius of handle 12 may be between 0.2 and 5 inches. In another embodiment, the radius of handle 12 may be between 0.5 and 1 inch. The cross-section of the cylindrical shape may be constant or may be irregular with varying cross-sections.

In one embodiment, handle 10 may have a circular cross-section with a tapered section 40. Tapered section 40 may reduce the radius of the handle 12 approximate to the hammer head 18. Tapered section 40 may reduce the radius of handle 12 approximate to the hammer head 18 by any amount. In one embodiment, tapered section 40 may reduce the radius of handle 12 approximate to the hammer head 18 by between 20-50%. In another embodiment, tapered section 40 may reduce the radius of handle 12 approximate to the hammer head 18 by approximately 64%. For example, handle 12 may have a radius of approximately 0.975 inches, and tapered section 40 may reduce the radius of handle 12 approximate to hammer head 18 to approximately 0.625 inches. Tapered section 40 may also have any desired length. For example, the length of tapered section 40 may be approximately 1.5 inches.

Handle 12 may be made out of any desired material. In one embodiment, handle 12 may be made out of an aluminum material. The aluminum material may be any desired aluminum, including, but not limited to, 6061 aluminum.

Figure 8:
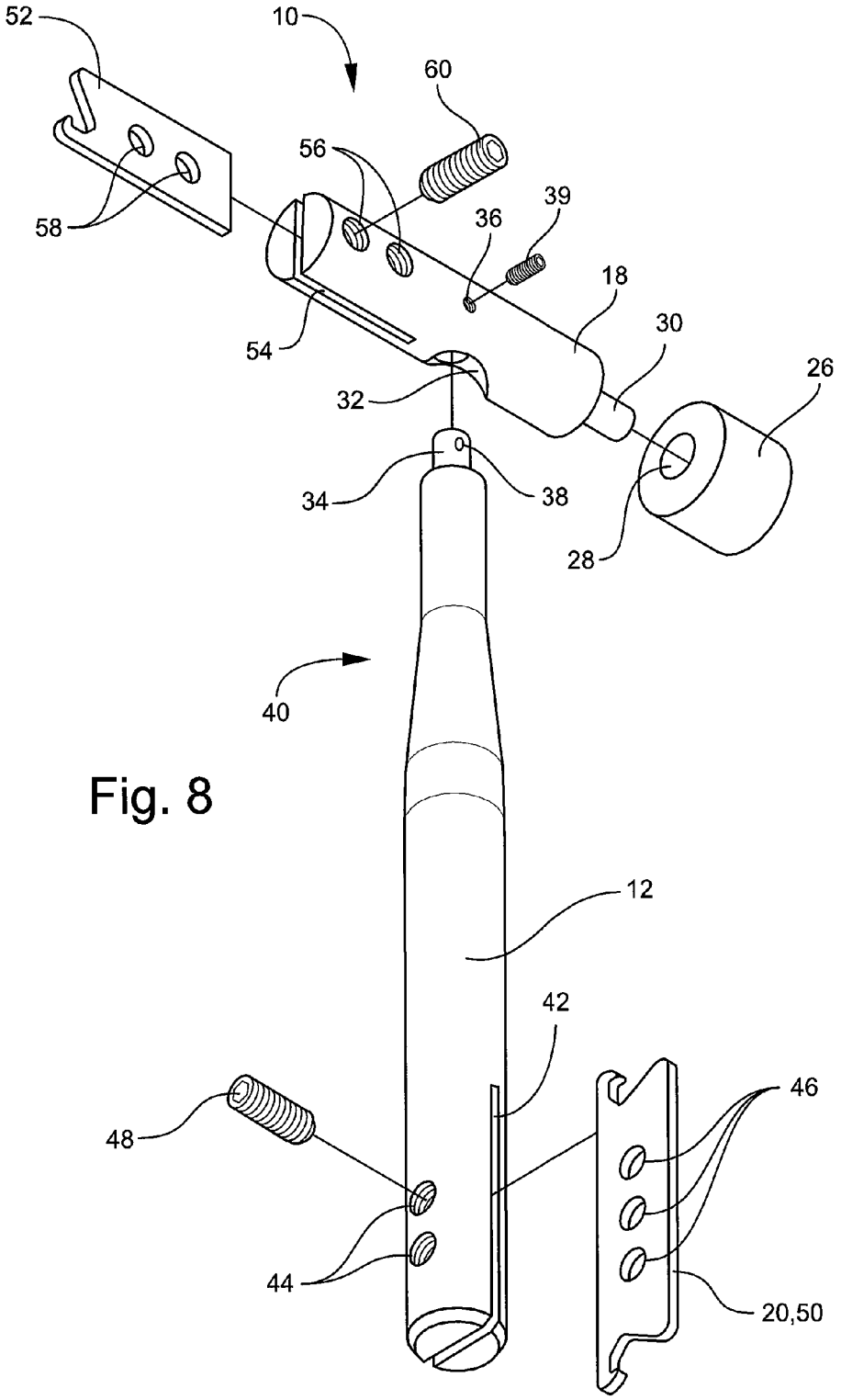
FIG. 8 shows a blown up perspective view of the wheel weight tool from FIG. 1.

Hammer head 18 may be attached to the first end 14 of handle 12 in wheel weight tool 10. See FIGS. 1-10. Hammer head 18 may be for providing a hammer head on handle 12. Hammer head 18 may be any desired shape or size of a hammer head. Hammer head 18 may have a soft end 22. For example, hammer head 18 may be for hammering a wheel weight onto a wheel utilizing soft end 22. Hammer head 18 may also include a hard end 24 that may optionally include a second hook 52. As another example, hammer head 18 may be utilized for removing wheel weights with hard end 24 via second hook 52. Hard end 24 may also not include second hook 52, where hard end 24 may be used as a standard hammer head. Hammer head 18 may be attached to handle 12 by any means. In one embodiment, as shown in FIG. 8, hammer head 18 may have a first head hole 32 approximate to its longitudinal center 33. In this embodiment, handle 12 may have a handle cylinder 34 protruding from the first end 14. The handle cylinder 34 may be adapted to fit inside of the first head hole 32. To hold the first head hole 32 on the handle cylinder 34, the hammer head may have a second head hole 36 perpendicular to the first head hole 32, and the handle cylinder 34 may have a cylinder hole 38. The cylinder hole 38 may be adapted to align with the second head hole 36, whereby a roll pin 39 (or other similar device) may be inserted through the hammer head 18 and handle cylinder 34 for attaching the hammer head 18 to the handle 12. The roll pin 39 may be any type of roll pin and may be made out of any material, including, but not limited to, being made of steel, like 3/16 steel.

Hammer head 18 may be made out of any desirable material. In one embodiment, hammer head 18 may be made out of steel. The hammer head steel may be any desired steel including, but not limited to, 1018 steel.

Soft end 22 may be included on hammer head 18 of wheel weight tool 10. See FIGS. 1-10. Soft end 22 may be for providing a soft hammering surface, i.e., a hammering surface that will not chip or scratch metal and alloy surfaces. Soft end 22 may be any type of soft hammering surface. In one embodiment, soft end 22 may have a soft cap 26. Soft cap 26 may be made of any soft material, including, but not limited to, being made of nylon. Soft cap 26 may be integrally built onto hammer head 18 or it may be removable. Having soft cap 26 removable from hammer head 18 may allow soft cap 26 to be replaceable when it becomes damages, warn, torn, etc. The removable soft cap 26 may be attached to hammer head 18 by any means. In one embodiment, as shown in FIG. 8, soft cap 26 may include a cap hole 28 adapted to be inserted onto a head cylinder 30. Head cylinder 30 may be protruding from soft end 22 of hammer head 18. In this embodiment, cap hole 28 may be dimensioned slightly smaller than head cylinder 30, whereby, frictional forces may maintain soft cap 26 on hammer head 18.

The first hook 20 may be included on the second end 16 of handle 12 in wheel weight tool 10. First hook 20 may be utilized by automobile technicians (or any person) for removing wheel weights from automobile wheels. First hook 20 may be attached to handle 12 at second end 16 by any means. In one embodiment, first hook 20 may be inserted through a handle slot 42 in the second end 16 of the handle 12. First hook 20 may be held in handle slot 42 by any means. In one embodiment, first hook 20 may be held in handle slot 42 by including a plurality of handle threaded holes 44 perpendicular to the handle slot 42. In this embodiment, the first hook 20 may have a corresponding amount of first hook holes 46 adapted to align with the plurality of handle threaded holes 44, whereby a plurality of first hook screws 48 may hold the first hook 20 in the handle slot 42. First hook 20 may have any dimensions adapted for removing a wheel weight, i.e., the first hook 20 may be dimensioned to grip wheel weight clip 63 via wheel weight clip hole 64. See FIG. 10. In one embodiment, first hook 20 may have a height 20*a*, a clearance height 20*b*, a width 20*c*, and a clearance width 20*d*. Height 20*a* may be any height including, but not limited to between 0.2 inches and 1 inch, or between 0.4 inches and 0.6 inches, or approximately 0.5 inches. Clearance height 20*b* may be any height including, but not limited to between 0.5 inches and 1.5 inches, or between 0.7 inches and 0.9 inches, or approximately 0.8 inches. Width 20*c* may be any width including, but not limited to between 0.005 inches and 0.100 inches, or between 0.010 inches and 0.050 inches, or approximately 0.032 inches. Clearance width 20*d* may be any width including, but not limited to between 0.05 inches and 0.10 inches, or between 0.1 inches and 0.3 inches, or approximately 0.21 inches. First hook 20 may be a simple one sided hook, or it may also be a two-sided hook 50, as shown in FIG. 8. Two sided hook 50 may allow a user to rotate sides once one side of the hook become warn or damaged. In addition, two sided hook 50 may be configured with two different sized hooks where a user may rotate the hooks to fit different sized wheel weights and clips.

In one embodiment of wheel weight tool 10, the hard end 24 of hammer head 18 may include a second hook 52. Second hook 52 may be utilized similar to first hook 20 where automobile technicians (or any person) may use the hook for removing wheel weights from automobile wheels. Second hook 52 may be attached to hammer head 18 at hard end 24 by any means. In one embodiment, second hook 52 may be inserted through a hammer head slot 54 in the hard end 24 of the hammer head 18. Second hook 52 may be held in hammer head slot 54 by any means. In one embodiment, second hook 52 may be held in hammer head slot 54 by including a plurality of hammer head threaded holes 56 perpendicular to the hammer head slot 54. In this embodiment, the second hook 52 may have a corresponding amount of second hook holes 58 adapted to align with the plurality of hammer head threaded holes 56, whereby a plurality of second hook screws 60 may hold the second hook 52 in the hammer head slot 54. Second hook 52 may have any dimensions adapted for removing a wheel weight, i.e., the second hook 52 may be dimensioned to grip wheel weight clip 63 via wheel weight clip hole 64. See FIG. 10. In one embodiment, second hook 52 may have a height 52*a*, a clearance height 52*b*, a width 52*c*, and a clearance width 52*d*. Height 52*a* may be any height including, but not limited to between 0.2 inches and 1 inch, or between 0.4 inches and 0.6 inches, or approximately 0.5 inches. Clearance height 52*b* may be any height including, but not limited to between 0.5 inches and 1.5 inches, or between 0.7 inches and 0.9 inches, or approximately 0.8 inches. Width 52*c* may be any width including, but not limited to between 0.005 inches and 0.100 inches, or between 0.010 inches and 0.050 inches, or approximately 0.032 inches. Clearance width 52*d* may be any width including, but not limited to between 0.05 inches and 0.10 inches, or between 0.1 inches and 0.3 inches, or approximately 0.21 inches. Second hook 52 may be dimensioned similar to first hook 20 or it may be designed with different dimensions to fit different sized wheel weights 62 and wheel weight clips 63.

First hook 20 and second hook 52 may be made out of any material adapted for removing wheel weights. In one embodiment, first hook 20 and second hook 52 may be made out of a steel material, including but not limited to, a heat treated steel.

Figure 9:
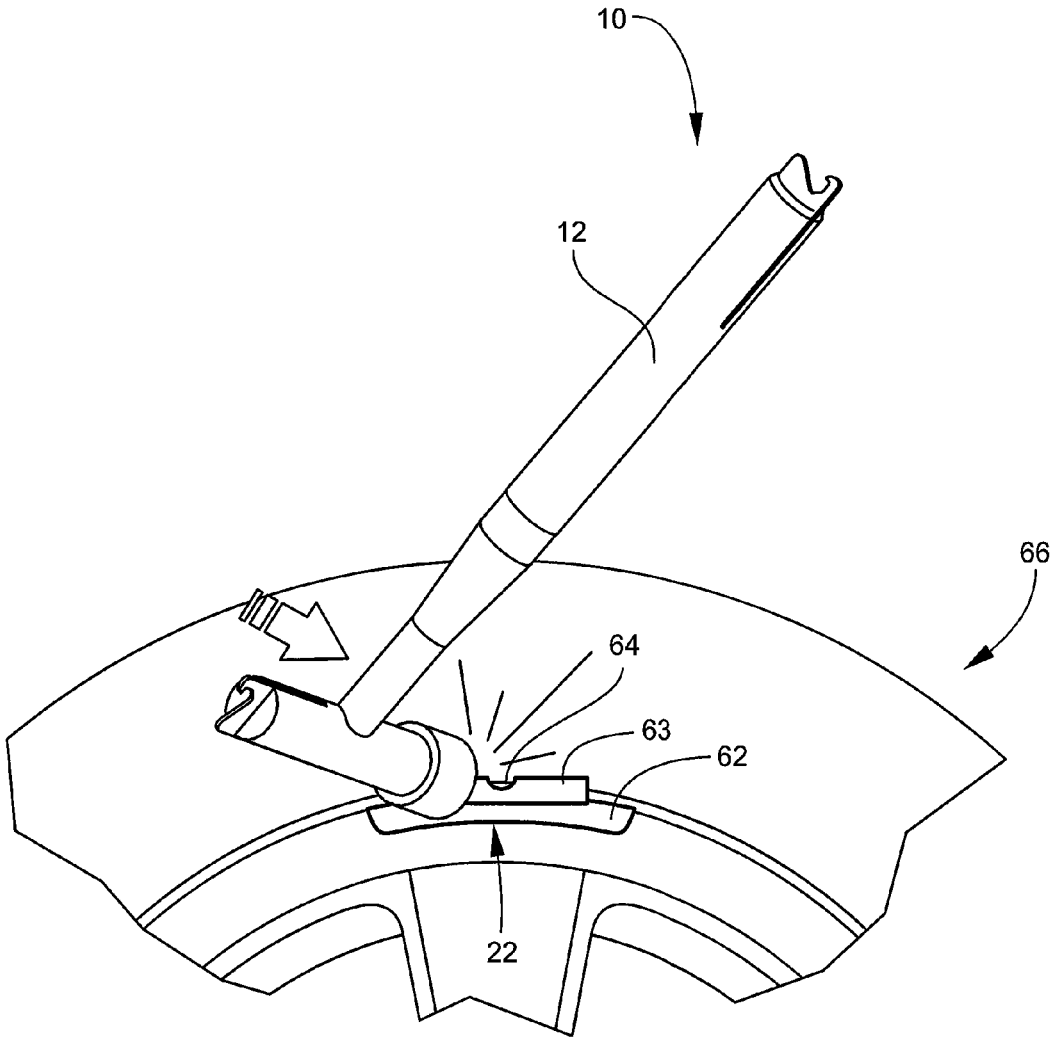
FIG. 9 shows an environmental view of the wheel weight tool from FIG. 1 being used to install a wheel weight.
Figure 11:
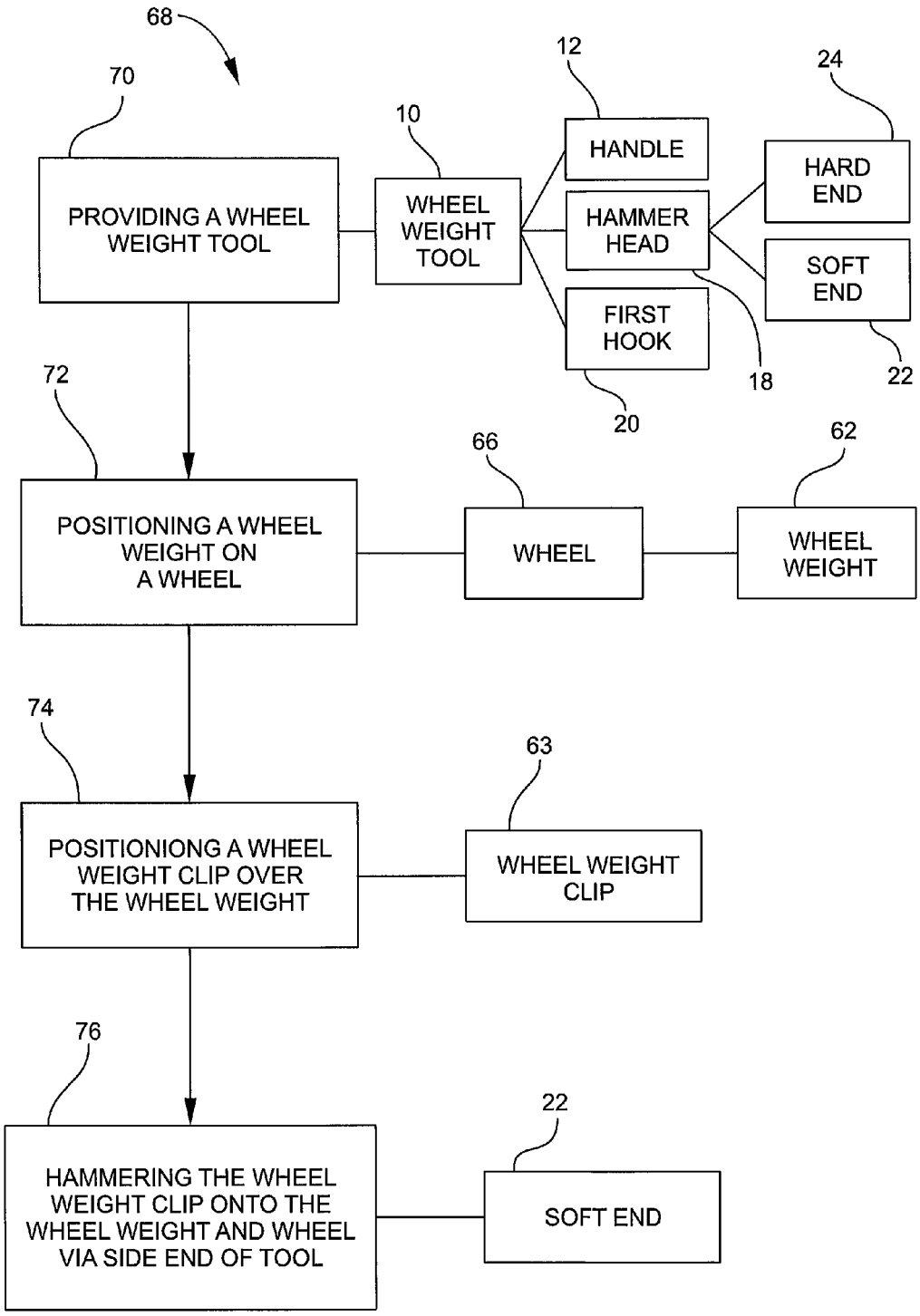
FIG. 11 shows a flow diagram of one embodiment of the method of installing a wheel weight according to the instant invention.

Referring to FIGS. 9 and 11, the instant invention also includes a method 68 of installing wheel weights. Method 68 may be for utilizing wheel weight tool 10 to install a wheel weight 62 onto a wheel 66 utilizing a wheel weight clip 63, as shown in FIG. 9. Method 68 may include any steps for utilizing wheel weight tool 10 to install wheel weights. In one embodiment, method 68 of installing wheel weights may include, but is not limited to, the following general steps: a step 70 of providing wheel weight tool 10, as described above; a step 72 of placing a wheel weight 62 on a wheel 66; a step 74 of placing a wheel weight clip 63 over the wheel weight 62; and a step 76 of hammering the wheel weight clip 63 onto the wheel weight 62 via the soft end 22 of wheel weight tool 76.

Figure 10:
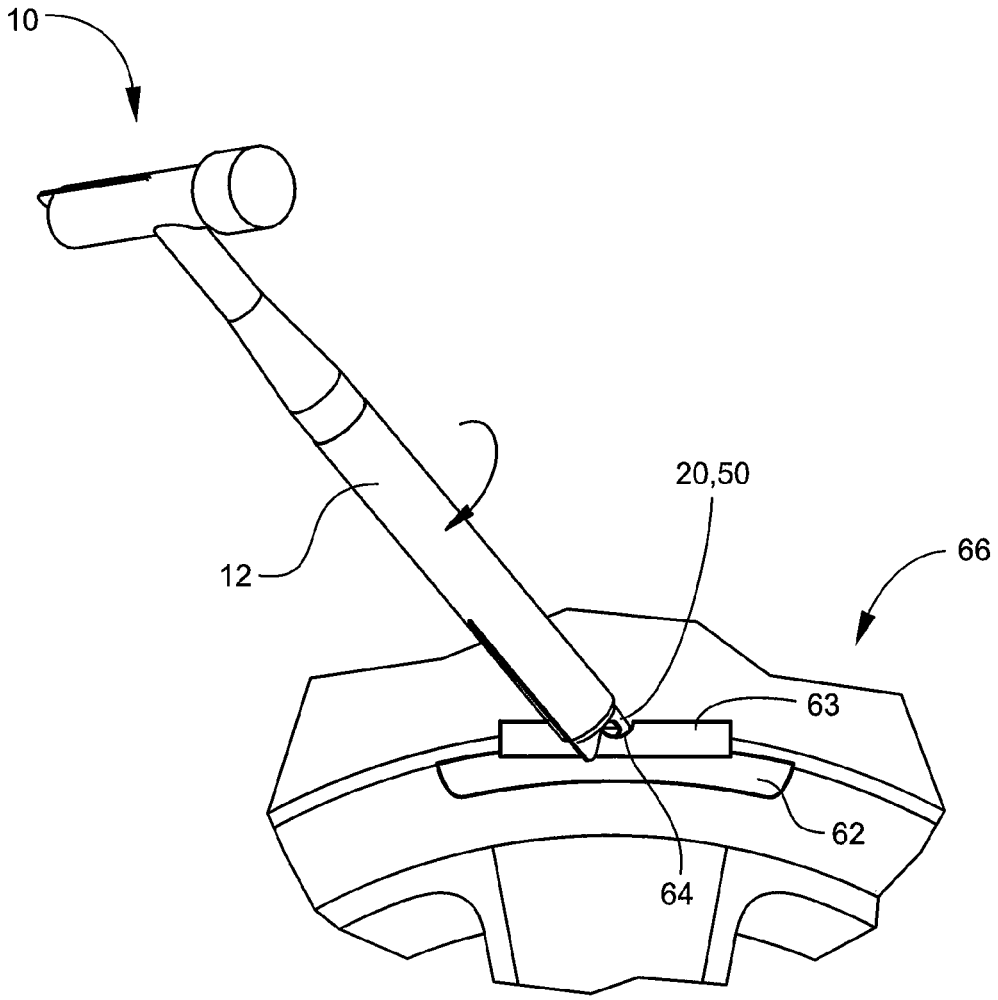
FIG. 10 shows another environmental view of the wheel weight tool from FIG. 1 being used to remove a wheel weight.
Figure 12:
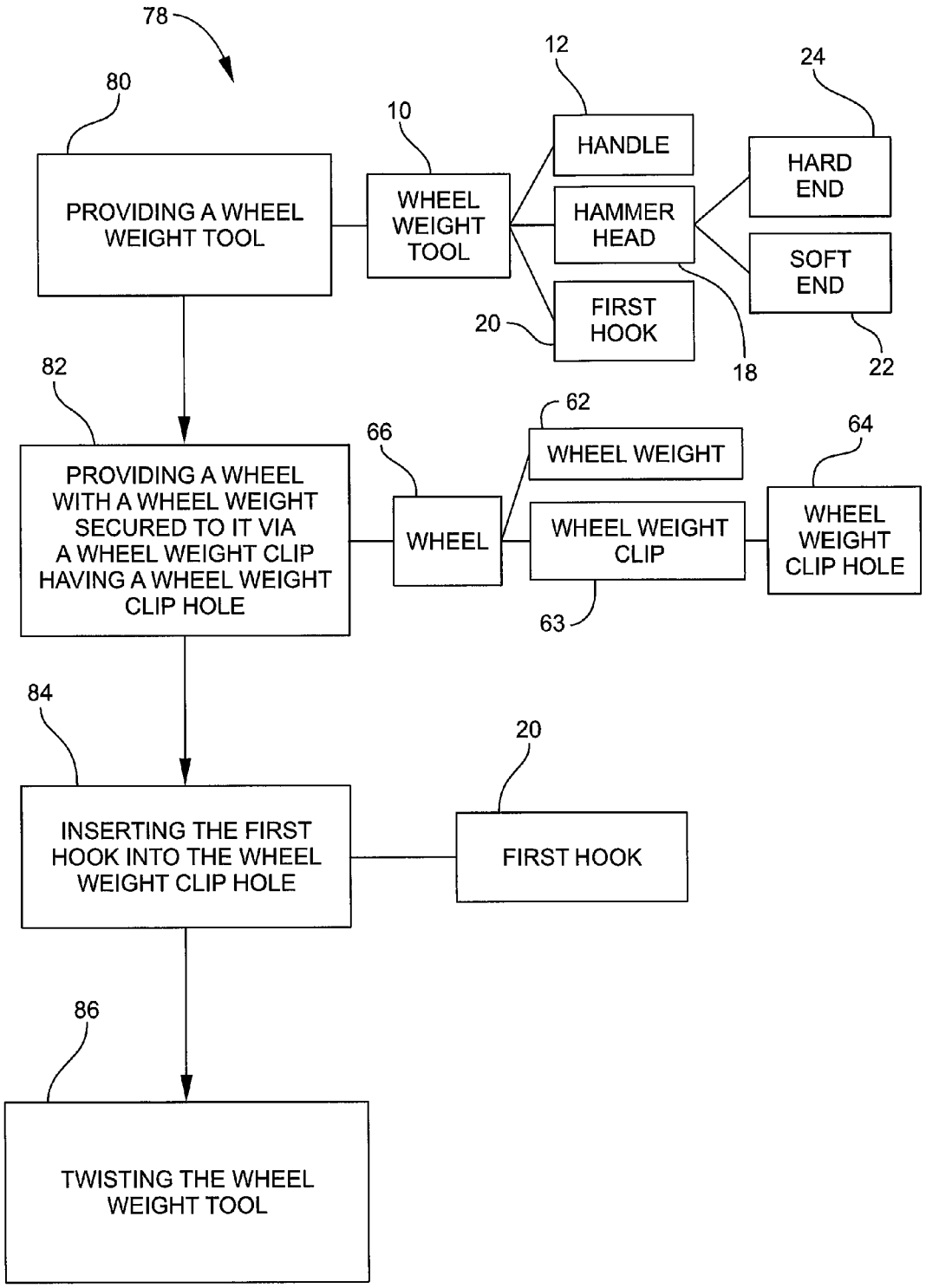
FIG. 12 shows a flow diagram of one embodiment of the method of removing a wheel weight according to the instant invention.
Figure 13:
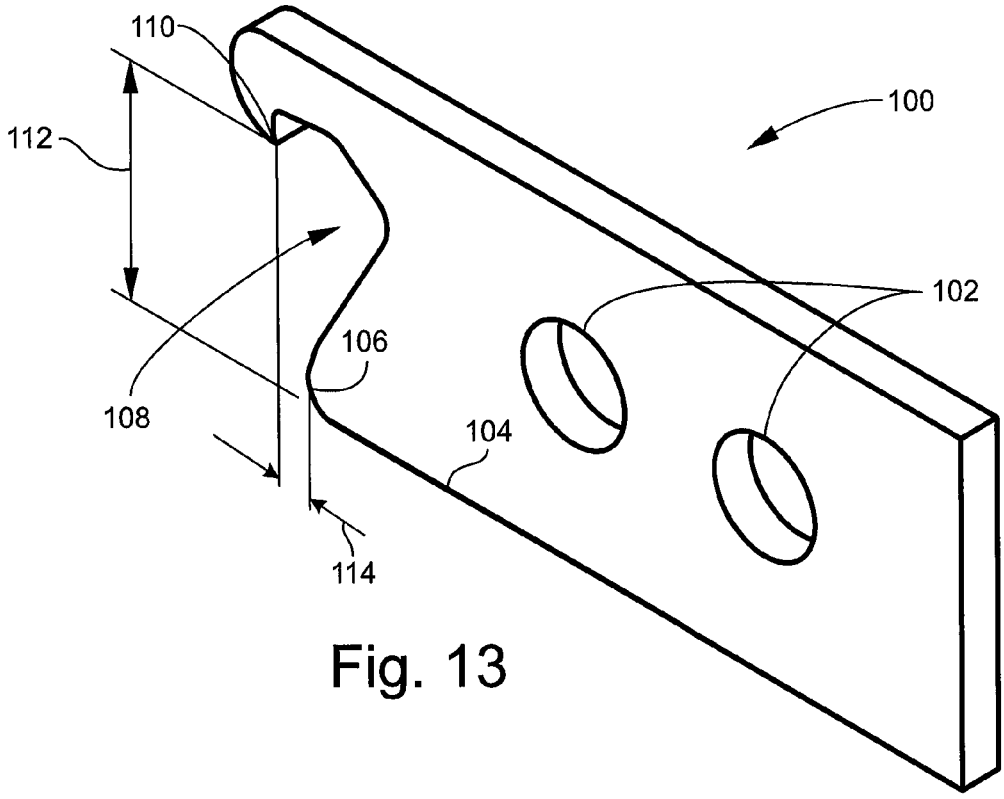
FIG. 13 shows a perspective view of one embodiment of the wheel weight removal hook according to the instant invention.

Referring to FIGS. 10 and 12, the instant invention also includes a method 78 of removing wheel weights. Method 78 may be for utilizing wheel weight tool 10 to remove a wheel weight 62 with a wheel weight clip 63 from a wheel 66, as shown in FIG. 10. Method 78 may include any steps for utilizing wheel weight tool 10 to remove wheel weights and wheel weight clips. In one embodiment, method 78 of removing wheel weights may include, but is not limited to, the following general steps: a step 80 of providing a wheel weight tool 10, as described above; a step 82 of providing a wheel 66 with a wheel weight 62 secured to it via a wheel weight clip 63 having a wheel weight clip hole 64; a step 84 of inserting the first hook 20 (or second hook 52) into the wheel weight clip hole 64 of the installed wheel weight 62; and a step 86 of twisting the wheel weight tool 10.

The instant invention is also directed to a wheel weight removal hook 100. See FIGS. 13-16. The wheel weight removal hook 100 may be used in any wheel weight removal tool, including but not limited to the instant wheel weight removal tool 10 as first hook 20 or second hook 52. However, the invention is not so limited and the wheel weight removal hook 100 may be used on or as a part of other tools and devices.

Wheel weight removal hook 100 may be a hook adapted to remove a wheel weight, as shown in FIG. 10. The hook 100 may be made out of any strong material capable of removing wheel weights. In one embodiment, the strong material may be a hardened flat steel. The hook may be designed with various dimensions for removing various wheel weights. The hooks may be provided in any width capable of providing enough strength to the hook to remove wheel weights. In one embodiment, the width of hook 100 may be approximately 1/10 inches. The hook may be provided with any height. In one embodiment, the heights of hook 100 may be approximately 7/8 inches.

The wheel weight removal hook 100 may include a tip point 110, a throat 108, and a heel 106. See FIGS. 13-16. The tip point 110 may be adapted to be inserted into the hole of a wheel weight clip. The tip point 110 may be designed with any size capable of being inserted into the hole of a wheel weight. The throat 108 may be adapted to fit around the clip and the weight. The throat 108 may be designed to fit around any size or shape clip and weight. The heel 106 may be adapted to be positioned against the weight or clip when the tip point 110 is inserted into the hole of a wheel weight clip, thereby, providing a leverage point or surface. The heel 106 may be a squared off point (as shown in the Figures), it may be rounded surface, or it may be any other shape that provides a leverage point or surface for hook 100. As such, when the tip point 110 is inserted into the hole of a wheel weight clip, the throat 108 may fit around the clip and the weight where the heel may be positioned against the weight. When the tip point 110 may be inserted into the hole of a wheel weight clip, where the heel 106 may be positioned against the weight, the hook 100 may be rotated for removing the wheel weight and clip from a wheel (see FIG. 10).

Optionally, wheel weight removal hook 100 may include a fastening device 102. Fastening device 102 may be any device adapted for allowing hook 100 to fasten to another object or device like a tool. The fastening device 102 may be for fastening the hook to another object like a tool. See FIG. 8. The fastening device 102 may be any device adapted for allowing the hook to be fastened or attached to another device. In one embodiment, the fastening device may be a plurality of holes, including, but not limited to 2 holes or 3 holes (see FIG. 8). For example, fastening device 102 may be holes adapted to align with holes in another device, like tool 100 of the instant invention, for securing the hook on the tool. However, the invention is not so limited, and fastening device 102 may be other forms of fastening devices designed to secure hook 100 on another device or tool.

Figure 14:
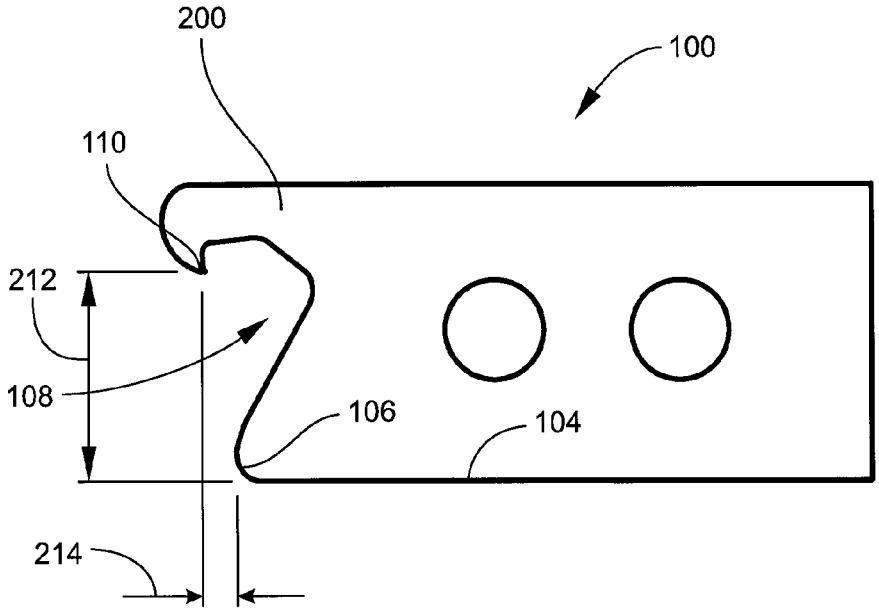
FIG. 14 shows a side view of the wheel weight removal hook shown in FIG. 13.

In one embodiment, the hook 100 may be provided with a hook design 200. See FIG. 14. Hook design 200 may be adapted for removing the majority of wheel weights and clips on the market (approximately 85%). As shown in the Wheel Weights Table at http://www.wheelweights.com/pdf/Wheel-_Weights_CompleteWeightsChart.pdf [retrieved on Oct. 3, 2012], the common abbreviations or names of the weights that the hook design 200 may remove may include, but are not limited to: AW/AL (red); MC (yellow); IAW/IW (blue); EN (green); FN (orange), LH (purple); TN/TT/TS (grey); and P/T (black) (for steel wheels). The throat 108 of hook design 200 may have a shape as shown in FIG. 14. The shape of throat 108 in hook design 200 may be a single concave shape with no points. The shape of the throat 108 may include a tip to heel height 212 and a tip to heel width 214. The tip to heel height 212 may be adapted for positioning the heel 106 against the desired wheel weight or clip when the tip point is inserted into the hole of the wheel weight clip. In one embodiment, the tip to heel height 212 may be from 0.550 inches to 0.580 inches. In another embodiment, the tip to heel height 212 may be from 0.561 inches to 0.571 inches. In yet another embodiment, the tip to heel height 212 may be approximately 0.566 inches. The tip to heel width 214, in combination with tip to heel height 212, may be adapted for positioning the heel 106 against the desired wheel weight or clip when the tip point 110 is inserted into the hole of the wheel weight clip. In one embodiment, the tip to heel width 214 may be from 0.070 inches to 0.100 inches. In another embodiment, the tip to heel width 212 may be from 0.080 inches to 0.090 inches. In yet another embodiment, the tip to heel width 214 may be approximately 0.085 inches.

Figure 15:
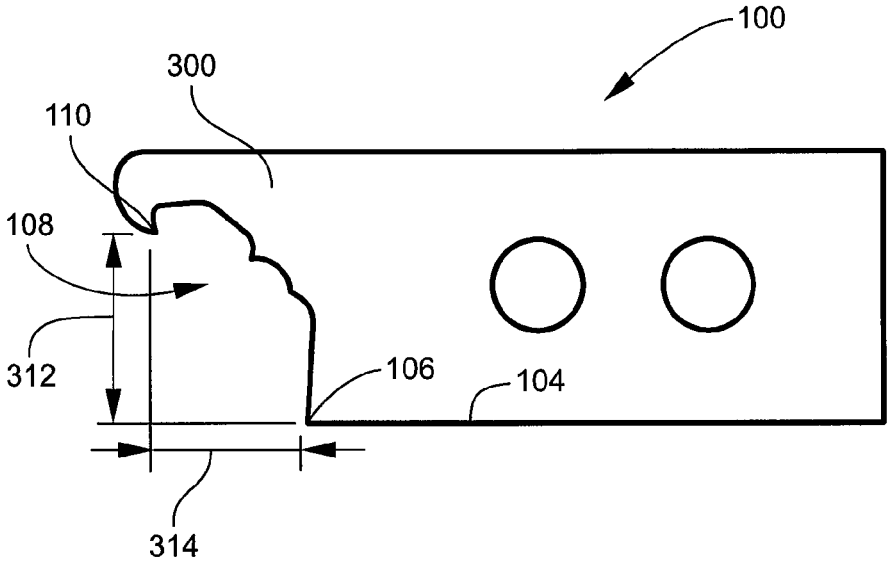
FIG. 15 shows a side view of another embodiment of a wheel weight removal hook according to the instant invention.

In another embodiment, the hook 100 may be provided with a hook design 300. See FIG. 15. Hook design 300 may be adapted for removing certain wheel weights. As shown in the Wheel Weights Table at http://www.wheelweights.com/pdf/Wheel_Weights_CompleteWeightsChart.pdf [retrieved on Oct. 3, 2012], the common abbreviations or names of the weights that the hook design 300 may remove may include, but are not limited to: BADA Brand—MC & MB/BM Weights. The throat 108 of hook design 300 may have a shape as shown in FIG. 15. The shape of throat 108 in hook design 300 may have 3 different concave portions with an apex in the middle of each concave portion, thereby providing 2 apexes. The shape of the throat 108 may include a tip to heel height 312 and a tip to heel width 314. The tip to heel height 312 may be adapted for positioning the heel 106 against the desired wheel weight or clip when the tip point is inserted into the hole of the wheel weight clip. In one embodiment, the tip to heel height 312 may be from 0.550 inches to 0.580 inches. In another embodiment, the tip to heel height 312 may be from 0.561 inches to 0.571 inches. In yet another embodiment, the tip to heel height 312 may be approximately 0.566 inches. The tip to heel width 314, in combination with tip to heel height 312, may be adapted for positioning the heel 106 against the desired wheel weight or clip when the tip point 110 is inserted into the hole of the wheel weight clip. In one embodiment, the tip to heel width 314 may be from 0.420 inches to 0.445 inches. In another embodiment, the tip to heel width 312 may be from 0.427 inches to 0.437 inches. In yet another embodiment, the tip to heel width 314 may be approximately 0.432 inches. As shown in FIG. 15, hook design 300 may also include various radius and curvatures in throat 108 for accommodating various wheel weights and clips.

Figure 16:
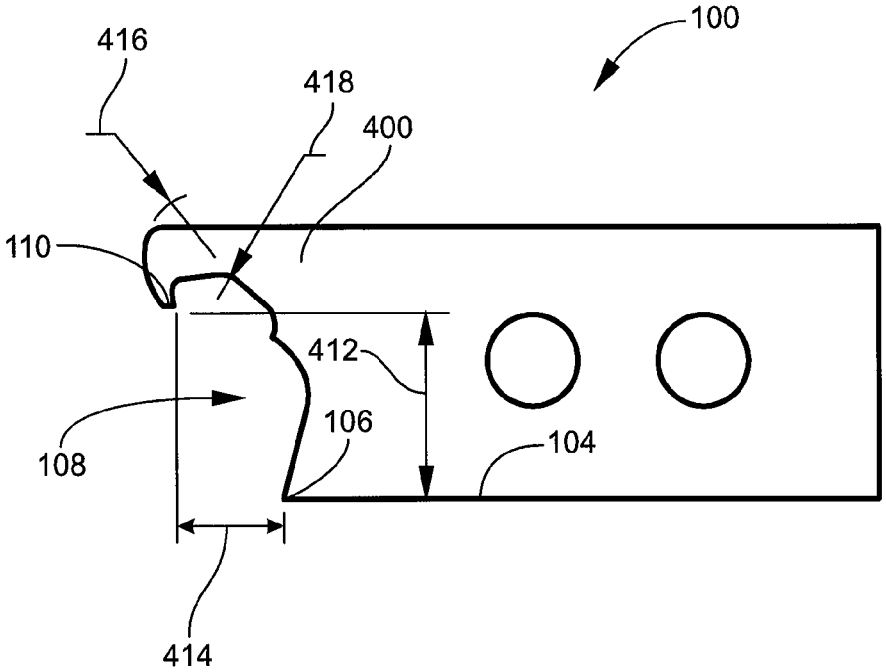
FIG. 16 shows a side view of yet another embodiment of a wheel weight removal hook according to the instant invention.

In another embodiment, the hook 100 may be provided with a hook design 400. See FIG. 16. Hook design 400 may be adapted for removing certain wheel weights. As shown in the Wheel Weights Table at http://www.wheelweights.com/pdf/Wheel_Weights_CompleteWeightsChart.pdf [retrieved on Oct. 3, 2012], the common abbreviations or names of the weights that the hook shown in FIG. 5 may remove may include, but are not limited to: ASIAN factory original equipment weights and FN aftermarket ASIAN weights. The throat 108 of hook design 400 may have a shape as shown in FIG. 16. The shape of throat 108 in hook design 400 may have 2 different concave portions with an apex in the middle of the two concave portions. The shape of the throat 108 may include a tip to heel height 412 and a tip to heel width 414. The tip to heel height 412 may be adapted for positioning the heel 106 against the desired wheel weight or clip when the tip point is inserted into the hole of the wheel weight clip. In one embodiment, the tip to heel height 412 may be from 0.550 inches to 0.580 inches. In another embodiment, the tip to heel height 412 may be from 0.561 inches to 0.571 inches. In yet another embodiment, the tip to heel height 412 may be approximately 0.566 inches. The tip to heel width 414, in combination with tip to heel height 412, may be adapted for positioning the heel 106 against the desired wheel weight or clip when the tip point 110 is inserted into the hole of the wheel weight clip. In one embodiment, the tip to heel width 414 may be from 0.300 inches to 0.320 inches. In another embodiment, the tip to heel width 412 may be from 0.305 inches to 0.315 inches. In yet another embodiment, the tip to heel width 414 may be approximately 0.310 inches. As shown in FIG. 16, hook design 400 may also include various radius and curvatures in throat 108 for accommodating various wheel weights and clips. In one embodiment, hook design 400 may include a first radius 416 and a second radius 418.

First radius 416 may be approximately 0.198 inches and second radius 418 may be approximately 0.075 inches.

In other embodiments of wheel weight removal hook 100 (not shown in the Figures), the throat 108 may have other shapes and sizes adapted to fit around other sized and shaped wheel weights and clips, including current and/or future wheel weights and clips.

The wheel weight removal hook 100 of the instant invention may be any shaped hook with any number of hooks included. In one embodiment, the hook may be a 1-sided hook (see FIGS. 8 and 13). In another embodiment, the hook 100 may be a 2-sided hook (see FIG. 8). In this 2-sided embodiment and any other multi-sided embodiments, the hooks may be the same hooks or may be different hooks, i.e. one side may be hook design 200 and the other side may be hook design 300 or 400.

The instant invention also contemplates providing a tool for removing a wheel weight that includes the wheel weight removal hook 100 as described above The instant invention also contemplates a method of manufacturing a wheel weight removal hook including at least the step of providing a wheel weight removal hook 100 as described above. This method may include any steps for providing the instant wheel weight removal hook.

The instant invention also contemplates a method of removing a wheel weight including at least the step of utilizing a wheel weight removal hook 100 as described above. This method may include any steps for removing a wheel weight utilizing the instant wheel weight removal hook 100.

The present invention may be embodied in other forms without departing from the spirit and the essential attributes thereof, and, accordingly, reference should be made to the appended claims, rather than to the foregoing specification, as indicated in the scope of the invention.

We claim:

1. A wheel weight removal hook comprising:

a hook adapted to remove a wheel weight comprising:

a tip point being adapted to be inserted into the hole of a wheel weight and clip;

a throat being adapted to fit around the wheel weight and clip; and a heel being adapted to be positioned against the weight and/or clip when the tip being inserted into the clip hole;

wherein said hook being made of a strong material capable of removing wheel weights being a hardened flat steel;

wherein, when said tip point being inserted into the hole of a wheel weight clip where said heel being positioned against said weight and/or clip, said hook may be rotated for removing the wheel weight and clip from a wheel.

2. The wheel weight removal hook of claim 1 wherein said hook having a width being approximately 1/10 inches.

3. The wheel weight removal hook of claim 1 wherein said hook having a height being approximately 7/8 inches.

4. The wheel weight removal hook of claim 1 wherein said throat having:

a tip to heel height; and a tip to heel width;

whereby, the combination of said tip to heel height and said tip to heel width being adapted for positioning the heel against the desired wheel weight or clip when the tip point is inserted into the hole of the wheel weight clip.

5. The wheel weight removal hook of claim 4 wherein:

said tip to heel height being from 0.550 inches to 0.580 inches; and said tip to heel width 214 being from 0.070 inches to 0.100 inches.

6. The wheel weight removal hook of claim 4 wherein:

said tip to heel height being from 0.561 inches to 0.571 inches; and said tip to heel width being from 0.080 inches to 0.090 inches.

7. The wheel weight removal hook of claim 4 wherein:

said tip to heel height being approximately 0.566 inches; and said tip to heel width being approximately 0.085 inches.

8. The wheel weight removal hook of claim 4 wherein:

said tip to heel height being from 0.550 inches to 0.580 inches; and said tip to heel width 214 being from 0.420 inches to 0.445 inches.

9. The wheel weight removal hook of claim 4 wherein:

said tip to heel height being from 0.561 inches to 0.571 inches; and said tip to heel width being from 0.427 inches to 0.437 inches.

10. The wheel weight removal hook of claim 4 wherein:

said tip to heel height being approximately 0.566 inches; and said tip to heel width being approximately 0.432 inches.

11. The wheel weight removal hook of claim 4 wherein:

said tip to heel height being from 0.550 inches to 0.580 inches; and said tip to heel width 214 being from 0.300 inches to 0.320 inches.

12. The wheel weight removal hook of claim 4 wherein:

said tip to heel height being from 0.561 inches to 0.571 inches; and said tip to heel width being from 0.305 inches to 0.315 inches.

13. The wheel weight removal hook of claim 4 wherein:

said tip to heel height being approximately 0.566 inches; and said tip to heel width being approximately 0.310 inches.

14. The wheel weight removal hook of claim 1 wherein said hook being a 1-sided hook or a 2-sided hook.

15. The wheel weight removal hook of claim 1 wherein said hook comprising a fastening device, said fastening device adapted to mount said hook on a tool.

16. The wheel weight removal hook of claim 15 wherein said fastening device being a plurality of holes.

* * * * *